US010107272B2

(12) United States Patent
Schnell et al.

(10) Patent No.: US 10,107,272 B2
(45) Date of Patent: Oct. 23, 2018

(54) SLIDING SHOE FOR A HYDROSTATIC AXIAL PISTON MACHINE

(71) Applicant: Robert Bosch GmbH, Stuttgart (DE)

(72) Inventors: Matthias Schnell, Rottenburg (DE); Stefan Hoppe, Sulz a.N. (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 222 days.

(21) Appl. No.: 15/154,093

(22) Filed: May 13, 2016

(65) Prior Publication Data

US 2016/0333867 A1 Nov. 17, 2016

(30) Foreign Application Priority Data

May 13, 2015 (DE) ..... 10 2015 208 886

(51) Int. Cl.

| | |
|---|---|
| ***F04B 1/12*** | (2006.01) |
| ***F04B 1/20*** | (2006.01) |
| ***F04B 1/14*** | (2006.01) |
| ***F03C 1/28*** | (2006.01) |
| ***F03C 1/06*** | (2006.01) |

(52) U.S. Cl.

CPC ..... *F04B 1/126* (2013.01); *F03C 1/0605* (2013.01); *F03C 1/0668* (2013.01); *F04B 1/122* (2013.01); *F04B 1/146* (2013.01); *F04B 1/2078* (2013.01)

(58) Field of Classification Search

CPC ..... F01B 3/007; F03C 1/0668; F04B 1/126

See application file for complete search history.

(56) References Cited

U.S. PATENT DOCUMENTS 6,802,916 B2 * 10/2004 Rateick, Jr. ..... B21K 1/76 148/674

FOREIGN PATENT DOCUMENTS

| | | |
|---|---|---|
| DE | 196 01 721 C2 | 1/1999 |
| DE | 102 35 813 A1 | 2/2004 |
| GB | 983 310 | 2/1965 |

* cited by examiner

*Primary Examiner* — F. Daniel Lopez

(74) *Attorney, Agent, or Firm* — Maginot, Moore & Beck LLP

(57) ABSTRACT

A sliding shoe for supporting a piston of a hydrostatic axial piston machine against a swash plate includes a sliding face that defines a central concentric pressure pocket that is flat in order to stabilize the sliding shoe. The pressure pocket has radial supply grooves in order to ensure an optimal supply of pressure medium to the pressure pocket from a central mouth opening. The radial supply grooves extend through the pressure pocket and as far as a circumferential groove which surrounds the pressure pocket.

15 Claims, 1 Drawing Sheet

SLIDING SHOE FOR A HYDROSTATIC AXIAL PISTON MACHINE

This application claims priority under 35 U.S.C. § 119 to patent application no. DE 10 2015 208 886.3, filed on May 13, 2015 in Germany, the disclosure of which is incorporated herein by reference in its entirety.

BACKGROUND

The disclosure relates to a sliding shoe for a hydrostatic axial piston machine of swash plate design.

In axial piston machines of swash plate design, a cylinder drum rotates together with a driving shaft. Axial cylinder bores and corresponding pistons are provided in the cylinder drum, in a uniform manner around the circumference. The pistons are coupled to a swash plate via their piston feet and via sliding shoes. As a result of the inclined position of the swash plate with respect to the rotation axis of the cylinder drum, the pistons execute a stroke movement out of the cylinder bore and a stroke movement into the cylinder bore upon each revolution of the cylinder drum. If the inclined position of the swash plate with respect to the cylinder drum is adjustable, the swept volume of the axial piston machine is adjustable.

The revolving sliding shoes have to be constantly held against the stationary swash plate and have in this case a sliding face by way of which they slide over the swash plate. Since the working pressure prevailing in the cylinder bores for a part of the revolving path thereof presses the sliding shoes in question against the swash plate, in order to minimize wear and to reduce frictional losses, hydrostatic relief means are provided in the sliding faces of the sliding shoes. Each sliding shoe has, on its sliding face, at least one flat relief recess, also known as a pressure pocket, for forming and defining a relieving pressure field. The relief force depends substantially on the size of the relief recess and the relief pressure prevailing therein. The relief pressure is tapped from the associated cylinder bore that is under working pressure and is transmitted to the relief recess via a duct in the piston and in the piston foot and via the ball joint and via a duct in the sliding shoe.

Since the comparatively low housing internal pressure of the axial piston machine prevails at the outer periphery of the sliding face, a pressure gradient arises between the relief recess and the outer periphery of the sliding face. In order to seal off the relief recess, the latter is surrounded by that part of the sliding face that bears against the swash plate.

In this case, various forms of relief recesses and corresponding forms of remaining sliding surfaces are known from the prior art, wherein said remaining sliding surfaces are often reduced to narrow webs. Furthermore, it is known practice to connect different spaced-apart relief recesses together via grooves.

UK 983,310 shows various sliding faces of a sliding shoe of a swash plate axial piston machine. Proceeding from the central mouth opening of the duct, various branched grooves have been introduced into the sliding face, said grooves forming the relief recesses.

DE 102 35 813 A1 and DE 196 01 721 C2 each show a sliding face of a sliding shoe of a swash plate axial piston machine, in which concentric relief recesses and corresponding concentric webs are provided. An inner circular relief recess and a concentric outer relief recess are connected together via at least one short radial duct which passes through a concentric web.

A disadvantage of the last-mentioned sliding shoes is that, during operation of the axial piston machine in question, they tend toward material displacements and smearing.

SUMMARY

Against this background, the disclosure is based on the object of creating a sliding shoe for a hydrostatic axial piston machine, said sliding shoe avoiding these disadvantages. This object is achieved by a sliding shoe having the features of the disclosure.

The sliding shoe serves for supporting a piston of a hydrostatic axial piston machine against a swash plate in particular via a ball joint. The sliding shoe has a sliding side which defines a sliding face via which the sliding shoe is brought into abutment against a swash plate. Arranged on the sliding side or in the sliding face is a central relief recess for forming a relieving pressure field. According to the disclosure, the relief recess is comparatively flat and comprises at least one groove which is deeper than the relief recess. The groove is thus formed in the relief recess and merges directly into the relief recess, since the latter extends adjacently to the groove on both sides. On account of the small depth of the relief recess, an increase in the stiffness of the sliding shoe results. The sliding shoe according to the disclosure avoids material displacements and smearing. Lapping of the pivot cradle can be dispensed with.

Further advantageous configurations of the disclosure are described in the dependent claims.

In a substantially rotationally symmetrical development of the sliding shoe or of the sliding face thereof, the relief recess is circular and thus easy to produce.

It is easy in terms of manufacturing for the two grooves to form a continuous rectilinear groove. In this way, the relief recess is subdivided into two semicircular inner "supporting webs" of maximum width, the connection of which to the central mouth opening is optimized via the two grooves.

The pressure-medium connection of the flat relief recess to the central mouth opening is improved when the relief recess is bounded by a first circumferential groove which is deeper than the relief recess. The first circumferential groove is bounded at its outer circumference by a sealing web.

The pressure-medium connection of the relief recess to the central mouth opening is optimal when the at least one groove—preferably both grooves—extend(s) in each case as far as the first circumferential groove.

In order to discharge leakage oil, a second circumferential groove can be arranged at the outer circumference of the sealing web, said second circumferential groove being bounded at its outer circumference by an outer supporting web.

Preferably, the second circumferential groove is narrower than the first circumferential groove, such that the width of the second circumferential groove is just enough to reliably discharge leakage oil.

Preferably, the outer supporting web is wider than the sealing web and wider than the two circumferential grooves. In this way, the properties of the sliding face are optimized further.

The outer supporting web can be passed through by at least one substantially radial connecting groove to the outer circumference of the sliding shoe. Optimal lubrication and cooling of the sliding shoe is achieved when two such radial connecting grooves are arranged opposite one another and transversely to the two grooves.

A "waterski effect" is achieved when a reduced outer peripheral region that is spaced apart from the swash plate is formed in the outer supporting web. This peripheral region is preferably formed in a crowned manner with a radius in a cross section located in an axial plane. It encompasses preferably about half the width of the supporting web in the radial direction. The reverse offset at the outer periphery of the supporting web is in the range from 8 to 15 micrometers, in particular in the region of 10 micrometers and in particular is 10 micrometers. The radius is in the region of 200 millimeters and in particular is 200 millimeters. The applicant reserves the right to direct claims at a sliding shoe having the particular features in the form of the supporting web, said claims not being restricted by the features of the current claims.

The "waterski effect" is improved when the peripheral region is at an angle of less than 15 degrees, preferably at most 10 degrees with respect to the swash plate.

BRIEF DESCRIPTION OF THE DRAWINGS

An exemplary embodiment of a sliding shoe according to the disclosure is illustrated in the drawings. The disclosure is now explained in more detail with reference to the figures of these drawings.

In the drawings.

DETAILED DESCRIPTION

Figure 1:
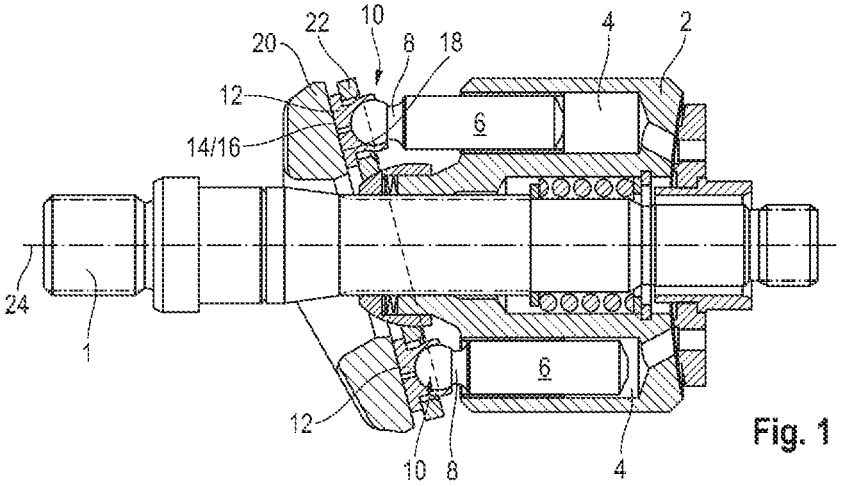
FIG. 1 shows a longitudinal section of the essential part of an axial piston machine of swash plate design, in which the exemplary embodiment of the sliding shoe according to the disclosure is installed.

FIG. 1 shows a drive mechanism of an axial piston machine in longitudinal section. It has a driving shaft 1, on the outer circumference of which a cylinder drum 2 is arranged for conjoint rotation. In the cylinder drum 2, a plurality of cylinder bores 4 are distributed uniformly around the circumference, wherein only two mutually opposite cylinder bores 4 are shown in FIG. 1. A piston 6 is guided in an axially movable manner in each cylinder bore 4, wherein each piston 6 has a piston foot 8 at its end portion remote from the cylinder drum 2, said piston foot 8 being coupled pivotably via a ball joint 10 to a respective sliding shoe 12 assigned to the piston 6.

Each sliding shoe 12 has, on its sliding side 14 remote from the ball joint 10, a planar sliding face 16 by way of which it revolves in a sliding manner around an inclined, planar, stationary sliding face 18 of a swash plate 20. Since the sliding shoes 12 are all held permanently in abutment against the sliding face 18 of the swash plate 20 via a holding-down means 22, the pistons 6 execute the desired stroke movement as they revolve about a central axis 24. Since the inclined position of the swash plate 20 with respect to the central axis 24 can be adjusted via an adjusting device (not shown), the stroke movement of each piston 6, and thus the swept volume of the axial piston machine, can be changed during a revolution.

Figure 2:
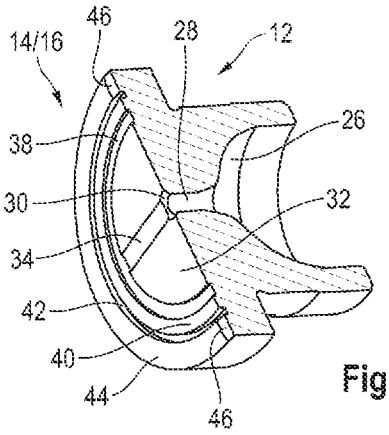
FIG. 2 shows a longitudinal section of the exemplary embodiment of the sliding shoe from FIG. 1.

FIG. 2 shows a perspective longitudinal section of a sliding shoe 12 from FIG. 1. In this case, a spherical recess 26 for receiving the piston foot 8 of the associated piston 6 can be seen. Arranged concentrically in the sliding shoe 12 is a duct 28 which connects the spherical recess 26 to a central mouth opening 30 in the sliding face 16. Via the duct 28, pressure medium from the cylinder bore 4, said pressure medium being under high pressure during a portion of the revolving path, is fed to the mouth opening 30. The mouth opening 30 is surrounded by a concentric, comparatively flat relief recess 32 which is subdivided into two semicircular parts, since two radial grooves 34 extend through the middle thereof, only one radial groove 34 being illustrated in FIG. 2.

Figure 3:
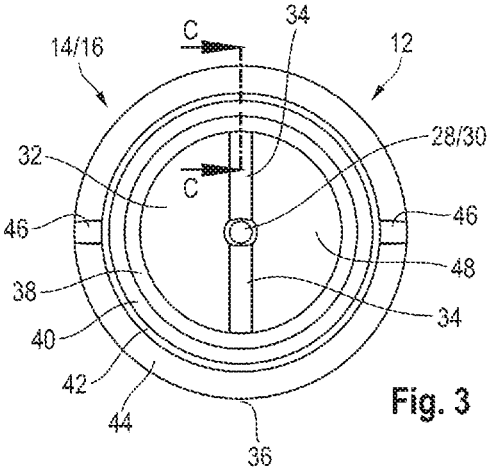
FIG. 3 shows a view of the sliding shoe according to FIGS. 1 and 2.

FIG. 3 shows a view of the sliding side 14 and thus of the sliding face 16 of the sliding shoe 12. It can be seen that the relief recess 32 is passed through by the two grooves 34, which both extend along a common groove line 36. Both grooves 34 are thus aligned with each other, and the mouth opening 30 is arranged on the groove line 36 between them. Provided at the outer circumference of the relief recess 32 is a circumferential groove 38, which bounds the relief recess 32.

In FIG. 2, it can be seen that the relief recess 32 is comparatively flat, while the two grooves 34 and the circumferential groove 38 are deeper than the relief recess 32. The two grooves 34 open into the circumferential groove 38, as a result of which the latter is connected to the mouth opening 30. The circumferential groove 38 is surrounded by a concentric sealing web 40 and thus bounded at its outer side. The sealing web 40 is in abutment against the sliding face 18 of the swash plate 20 when the axial piston machine in question is in operation (cf. FIG. 1).

Provided concentrically at the outer circumference of the sealing web 40 is a second circumferential groove 42 which serves to discharge the leakage oil which passes between the sealing web 40 and the sliding face 18 of the swash plate 20. The second circumferential groove 42 is, as can be seen in FIG. 2, deeper and narrower than the first circumferential groove 38. Provided at the outer circumference of the second circumferential groove 42 is a concentrically encircling supporting web 44 which bears against the sliding face 18 of the swash plate 20 during operation of the axial piston machine in question.

Provided on mutually opposite sides of the supporting web 44 at right angles to the two grooves 34 and to the first groove line 36 are two connecting grooves 46, which likewise extend along a common second groove line 48 which is arranged at right angles to the first groove line 36. Via these two connecting grooves 46, the second circumferential groove 42 is connected to the outer circumference of the sliding shoe 12 and thus to the housing interior of the axial piston machine in question.

Figure 4:
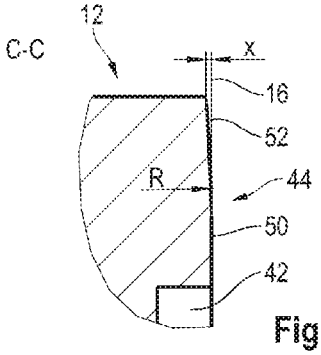
FIG. 4 shows a longitudinal section of a detail of the sliding shoe according to FIGS. 1 to 3.

FIG. 4 shows a section through the supporting web 44, which is arranged between the outer circumference of the sliding shoe 12 and the second circumferential groove 42. It can be seen that the supporting web 44 has an inner annular region 50 which is in abutment against the sliding face 18 of the swash plate 20 during operation of the axial piston machine in question and is thus located in the sliding face 16 of the sliding shoe. Furthermore, the supporting web 44 has an outer, crowned, rounded peripheral region 52. The latter encompasses preferably about half the width of the supporting web in the radial direction. The reverse offset x at the outer periphery of the supporting web is in the region of 10 micrometers and is in particular 10 micrometers in the exemplary embodiment shown. The radius is 200 millimeters. As a result of this shaping of the supporting web 44, a waterski effect is allowed.

Disclosed is a sliding shoe for supporting a piston of a hydrostatic axial piston machine against a swash plate. Formed in a sliding face of the sliding shoe is a central concentric pressure pocket which is flat in order to stabilize the sliding shoe. In order nevertheless to ensure an optimal supply of the pressure pocket with pressure medium from a central mouth opening, radial supply grooves are provided which extend through the pressure pocket and as far as a circumferential groove which surrounds the pressure pocket.

LIST OF REFERENCE SIGNS

1 Driving shaft
2 Cylinder drum
4 Cylinder bore
6 Piston
8 Piston foot
10 Ball joint
12 Sliding shoe
14 Sliding side
16 Sliding face
18 Sliding face
20 Swash plate
22 Holding-down means
24 Central axis
26 Spherical recess
28 Duct
30 Mouth opening
32 Relief recess
34 Grooves
36 First groove line
38 First circumferential groove
40 Sealing web
42 Second circumferential groove
44 Supporting web
46 Connecting groove
48 Second groove line
50 Inner annular region
52 Peripheral region
R Rounding radius
x Maximum distance

What is claimed is:

1. A sliding shoe, comprising:

a sliding side configured to bring the sliding shoe into abutment against a swash plate, the sliding side defining (i) a central relief recess configured to form a relieving pressure field, and (ii) at least one radial groove formed in the relief recess in order to be deeper than the relief recess, wherein:

the sliding side defines a central mouth opening;

the at least one radial groove includes a first and a second radial groove, each of the first and second radial grooves extending radially outwardly from the central mouth opening; and the first and second radial grooves are aligned with one another.

2. The sliding shoe according to claim 1, wherein the relief recess is circular in a plane parallel to the sliding face when the sliding shoe abuts the sliding face.

3. The sliding shoe according to claim 1, wherein:

the relief recess is surrounded by a first circumferential groove that is deeper than the relief recess, the first circumferential groove having an outer circumference that is surrounded by a sealing web;

a second circumferential groove is arranged at an outer circumference of the sealing web, the second circumferential groove having an outer circumference that is surrounded by an outer supporting web; and the outer supporting web defines two substantially radial connecting grooves to an outer circumference of the sliding shoe, the two radial connecting grooves extending approximately at right angles to the two radial grooves.

4. The sliding shoe according to claim 3, wherein the outer supporting web is wider than the sealing web and wider than the first and second circumferential grooves.

5. The sliding shoe according to claim 4, wherein the outer supporting web defines at least one substantially radial connecting groove to an outer circumference of the sliding shoe.

6. The sliding shoe according to claim 3, wherein the outer supporting web has an outer beveled peripheral region.

7. The sliding shoe according to claim 6, wherein the peripheral region is at an angle of less than 10 degrees with respect to a sliding face.

8. A sliding shoe, comprising:

a sliding side configured to bring the sliding shoe into abutment against a swash plate, the sliding side defining (i) a central relief recess configured to form a relieving pressure field, and (ii) at least one radial groove formed in the relief recess in order to be deeper than the relief recess, wherein the relief recess is surrounded by a first circumferential groove that is deeper than the relief recess, the first circumferential groove having an outer circumference that is surrounded by a sealing web.

9. The sliding shoe according to claim 8, wherein the at least one radial groove extends radially to the first circumferential groove.

10. The sliding shoe according to claim 8, wherein a second circumferential groove is arranged at an outer circumference of the sealing web, the second circumferential groove having an outer circumference that is surrounded by an outer supporting web.

11. The sliding shoe according to claim 10, wherein the outer supporting web is wider than the sealing web and wider than the first and second circumferential grooves.

12. The sliding shoe according to claim 10, wherein the outer supporting web defines at least one substantially radial connecting groove to an outer circumference of the sliding shoe.

13. The sliding shoe according to claim 10, wherein the outer supporting web has an outer beveled peripheral region.

14. The sliding shoe according to claim 13, wherein the peripheral region is at an angle of less than 10 degrees with respect to a sliding face.

15. The sliding shoe according to claim 8, wherein the relief recess is circular in a plane parallel to the sliding face when the sliding shoe abuts the sliding face.

* * * * *